US009617043B2

(12) United States Patent
McGirr et al.

(10) Patent No.: US 9,617,043 B2
(45) Date of Patent: Apr. 11, 2017

(54) CONTAINER WITH TWIST-OFF CLOSURE

(71) Applicant: Crown Packaging Technology, Inc., Alsip, IL (US)

(72) Inventors: Laura Jane McGirr, Londonderry (GB); Anne Elizabeth Nicholls, Gloucestershire (GB); Christopher Paul Ramsey, Oxfordshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 14/399,074

(22) PCT Filed: May 3, 2013

(86) PCT No.: PCT/EP2013/059241

§ 371 (c)(1),
(2) Date: Nov. 5, 2014

(87) PCT Pub. No.: WO2013/167483

PCT Pub. Date: Nov. 14, 2013

(65) Prior Publication Data

US 2015/0108132 A1 Apr. 23, 2015

(30) Foreign Application Priority Data

May 8, 2012 (EP) ..... 12167168

(51) Int. Cl.
*B65D 53/00* (2006.01)
*B65D 41/04* (2006.01)
(Continued)

(52) U.S. Cl.
CPC ..... *B65D 41/0428* (2013.01); *B65D 1/0253* (2013.01); *B65D 1/10* (2013.01);
(Continued)

(58) Field of Classification Search
CPC ..... B65D 41/0428; B65D 41/0435; B65D 41/0457; B65D 41/16; B65D 41/165;
(Continued)

(56) References Cited

U.S. PATENT DOCUMENTS 3,181,719 A * 5/1965 Schaich ..... B65D 41/0442 215/295
3,631,650 A * 1/1972 Leftault, Jr. ..... B65D 41/0457 215/334

(Continued)

FOREIGN PATENT DOCUMENTS

EP 2431297 A1 3/2012
WO WO 2013/167483 A1 11/2013

*Primary Examiner* — Steven A. Reynolds
*Assistant Examiner* — Javier A Pagan
(74) *Attorney, Agent, or Firm* — Baker & Hostetler LLP

(57) ABSTRACT

A container comprises a releasable metal closure formed with an end wall and a depending skirt and having an annular layer of sealing compound provided on the inside of the end wall adjacent the skirt and a container body comprising a neck with an annular sealing surface surrounding a circular opening and adapted to seal against the annular layer of sealing compound over an annular sealing interface in the closed position of the closure on the container body. The container body and the closure are formed with no mechanical means for coupling them together to form or maintain a seal therebetween and the seal is provided by a partial vacuum formed in the container during processing. The annular sealing surface of the container body is formed with a localized protrusion or recess which provides a discontinuity in the annular sealing interface, whereby relative rotation of the closure and container body from the closed position creates a venting path from the interior of the container body to the exterior so that the seal is broken and the closure is released.

14 Claims, 7 Drawing Sheets

(51) Int. Cl.

| | |
|---|---|
| ***B65D 1/02*** | (2006.01) |
| ***B65D 41/16*** | (2006.01) |
| ***B65D 51/16*** | (2006.01) |
| ***B65D 1/10*** | (2006.01) |

(52) U.S. Cl.
CPC ..... *B65D 41/165* (2013.01); *B65D 51/1688* (2013.01); *B65D 2543/00546* (2013.01)

(58) Field of Classification Search
CPC ..... B65D 41/17; B65D 1/0253; B65D 1/023; B65D 1/10; B65D 51/1688; B65D 51/1672; B65D 51/1633; B65D 51/16
See application file for complete search history.

(56) References Cited

U.S. PATENT DOCUMENTS

| | | | | | |
|---|---|---|---|---|---|
| 3,690,497 | A | * | 9/1972 | Lecinski, Jr. ..... | B65D 41/0457 215/318 |
| 4,227,616 | A | * | 10/1980 | Lecinski, Jr. ..... | B65D 41/16 215/246 |
| 4,444,325 | A | * | 4/1984 | Lecinski, Jr. ..... | B65D 41/16 215/346 |
| 4,452,365 | A | * | 6/1984 | Ascasibar-Verdejo . | B65D 41/16 215/346 |
| 4,552,279 | A | * | 11/1985 | Mueller ..... | B65D 41/0457 215/318 |
| 4,576,299 | A | * | 3/1986 | Lecinski, Jr. ..... | B65D 41/0457 215/318 |
| 4,603,786 | A | * | 8/1986 | Lecinski, Jr. ..... | B65D 41/0457 215/318 |
| 2003/0155322 | A1 | | 8/2003 | Auer et al. | |
| 2007/0289978 | A1 | | 12/2007 | Fuchs | |

* cited by examiner

CONTAINER WITH TWIST-OFF CLOSURE

CROSS-REFERENCE TO RELATED APPLICATIONS

This application is the National Stage of International Application No. PCT/EP2013/059241, filed May 3, 2013, which claims the benefit of European application number 12167168.9, filed May 8, 2012, the disclosures of which are incorporated herein by reference in their entirety.

TECHNICAL FIELD

The invention relates to a container comprising a glass container body and a releasable metal closure containing an annular layer of sealing compound.

BACKGROUND

Containers are well known in which a metal, releasable cap closure Traditionally, the cap is screw fitted onto the body such that the upper surface of the neck of the container seals against the layer of sealing compound. Filling speeds for such containers are generally up to about 500 containers per minute.

Because of the time taken to fit a screw closure during production, a modified arrangement has been developed in which a closure is formed with sealing compound moulded to the outer part of the closure end wall and to the inside of the closure sidewall or skirt. This kind of closure may be push fitted onto a screw threaded container during production of a filled container. Filling speeds for such containers may be up to about 1,000 containers per minute. The screw threads of the body dig into the sealing compound to form at least a partial thread therein such that, when the container comes to be opened, relative rotation of the closure and container body will break the seal and allow the closure to be removed. This arrangement is useful for certain food products where a partial vacuum is maintained in the container after filling and closure. During the filling process of the container, steam is injected into the open container in the head space above the hot food product which has been measured into the container. The closure is then pressed down onto the container and, as the steam condenses, a partial vacuum is formed in the container above the head space which acts to hold the closure firmly in place on the container body. In the fully cooled filled container, the typical vacuum in the container is about 0.3 bar. This partial vacuum must be vented to allow the cap closure to be removed.

In another known container, a glass container body in the form of a glass tumbler is formed with an annular bead around its upper end. The tumbler body is molded and then treated to melt its upper end edge to form the bead which is smooth for drinking. A flexible aluminium closure is snapped over the bead and forms a seal with the body by virtue of a partial vacuum formed in container during processing. The seal is broken by prying off the closure.

A steel closure cannot be used in this arrangement since steel is not sufficiently flexible for use in a pry-off closure.

SUMMARY

The invention provides a container which can be opened by twisting the closure in which neither the container, nor the closure needs to be provided with a screw thread nor any other mechanical engagement means for securing the closure to the body. In the arrangement of the present invention, the closure is held on the container body by virtue of the partial vacuum formed in the container body during processing of the container to fill it with a food or beverage product. The container body is provided with a discontinuity on its annular sealing surface which causes the interior of the body to be vented when the closure is rotated from the original closed position so that the seal is broken and the closure is released.

According to the invention, there is provided a container comprising: a releasable metal closure formed with an end wall and a depending skirt and having an annular layer of sealing compound provided on the inside of the end wall adjacent the skirt; and a glass container body comprising a neck with an annular sealing surface surrounding a circular opening and adapted to seal against the annular layer of sealing compound over an annular sealing interface in the closed position of the closure on the container body; wherein the container body and the closure are formed with no mechanical means for coupling them together to form or maintain a seal therebetween and the seal is provided by a partial vacuum formed in the container during processing; wherein the annular sealing surface of the container body is formed with a localised protrusion or recess which provides a discontinuity in the annular sealing interface; whereby relative rotation of the closure and container body from the closed position creates a venting path from the interior of the container body to the exterior so that the seal is broken and the closure is released.

The invention provides several advantages.

It is not necessary to provide a screw thread on the container neck. This greatly simplifies manufacture of the container body and saves on material since a shorter neck can be provided.

Having only an annular layer of sealing compound on the end wall of the cap closure means that the sealing compound need not be moulded but can form under gravity. This uses less compound, greatly simplifies manufacture and removes the scrap generated in the compound moulding process.

Since the cap closure does not require lugs to engage a thread, a very small radial gap can be provided between the skirt of the closure and the neck of the container body. This reduces the risk of ingress of foreign matter, bugs, etc. and also increases resistance to accidental damage.

The absence of any threads on the cap means it can have reduced height, thus saving in material.

Since the closure is removed by twisting rather than being pried off, it can be made of steel. Steel closures are sufficiently elastic to be formed with vacuum indicating buttons. Thus containers in accordance with the invention can be used with a wide variety of food and beverage products.

The torque required to open a container made in accordance with the invention is considerably less than typically required to open a threaded container. For example, the opening torque for a 51 mm closure has been reduced from about 3.4 Nm to only about 1.0 Nm. Reduction in the opening torque allows the use of fewer lubricants in the compound. These lubricants are one of the principle causes of migration into the food during processing. Thus, the new design also has benefits for food safety.

BRIEF DESCRIPTION OF THE DRAWINGS

Embodiments of the invention are described below with reference to the accompanying drawings, in which.

DETAILED DESCRIPTION OF ILLUSTRATIVE EMBODIMENTS

Mode(s) for Carrying Out the Invention

Figure 9:
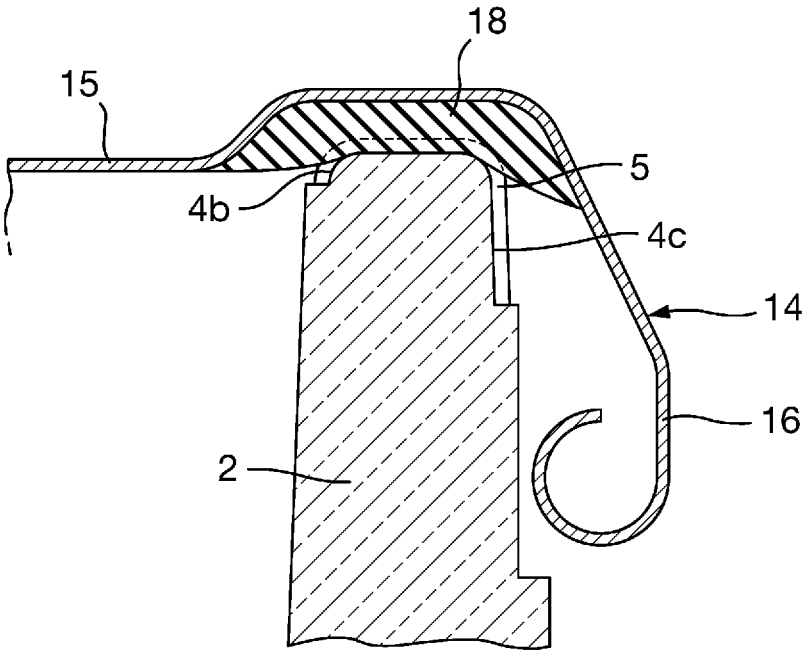
FIG. 9 is a radial sectional view through the neck of the first container and the closure.

A first embodiment, shown in FIGS. 1 to 3, 7 and 9, comprises a glass container body 1 having a neck 2 with a circular opening 3 surrounded by an upper rim which defines an annular sealing surface 4 which is provided primarily by the generally flat top edge face 4*a* of the neck and also by the upper parts of the inner and outer surfaces 4*b*, 4*c* of the neck. A venting feature 5 comprising a localised discontinuity in the surface 4 is provided by a small protrusion which extends generally radially across the surface 4 so as to extend downwardly beyond the reach of the annular layer of sealing compound when a closure is fitted as best seen in FIG. 9 so that it extends continuously from the interior of the container body to the exterior of the container body. The protrusion has a curved circumferential profile generally comprising an upslope 7, a curved top 8 and a downslope 9. The upslope 7 is inclined to the surface 4 at an angle theta which is less than 30 degrees. The angle theta is on the trailing edge so that ajar can be opened by rotating the closure conventionally anti-clockwise.

In one embodiment the container neck has an external diameter of about 51 mm and the protrusion has a circumferential length of about 1.0 mm and a height of about 0.2 mm. All the radiuses on the protrusion are about 0.2 mm. This is so the features can press into the soft sealing compound to create a continuous sealing surface during capping. Such a container body may be moulded from glass.

In a second embodiment, shown in FIGS. 4 to 6 and 8, the venting feature 10 is provided by a discontinuity that is a shallow recess or groove having a continuously curved surface 11. The recess again extends radially across the sealing surface 4 and partially down the inner and outer surfaces 4*b*, 4*c* of the neck 2 so that it extends continuously from the interior of the container body to the exterior of the container body.

The venting feature 10 has a circumferential length of about 5 mm and a depth of about 0.2 mm. In a preferred embodiment the profile of the recess is part circular with a radius of about 16 mm. Thus, the recess in the annular sealing surface 4 is part cylindrical.

Figure 12:
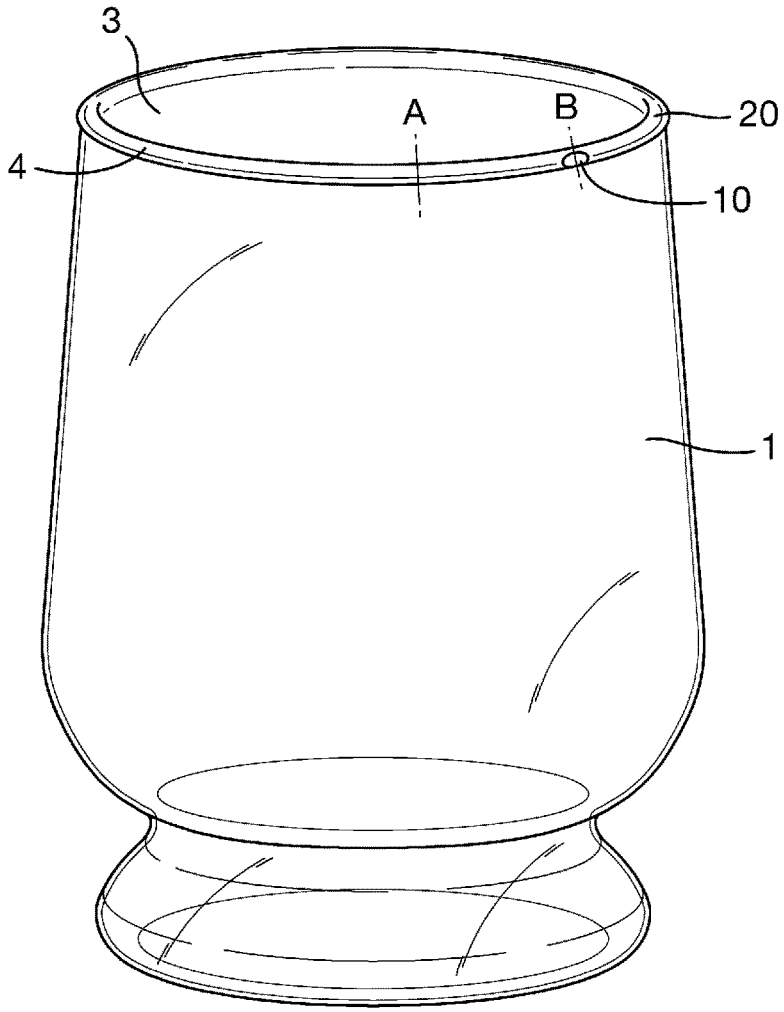
FIG. 12 is an isometric view of variant of the second container body.
Figure 13:
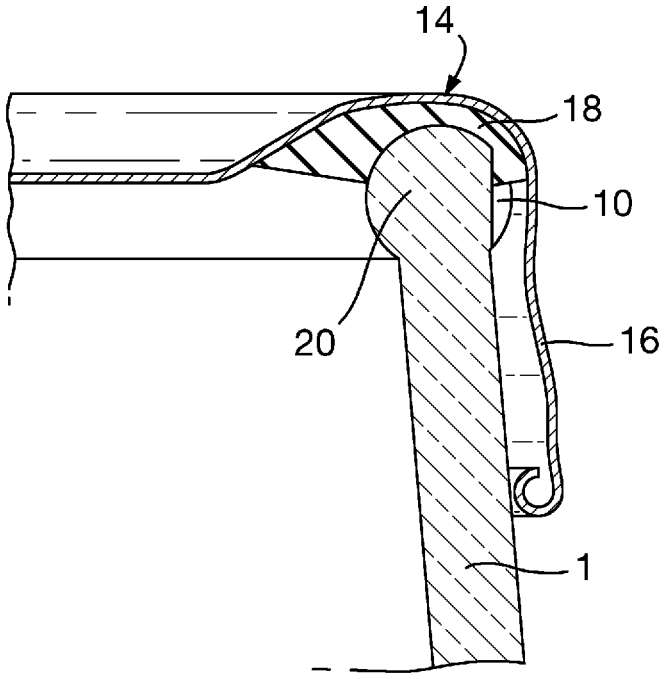
FIG. 13 is a radial section view through the top portion of the container and a closure taken at the point A of FIG. 12.
Figure 14:
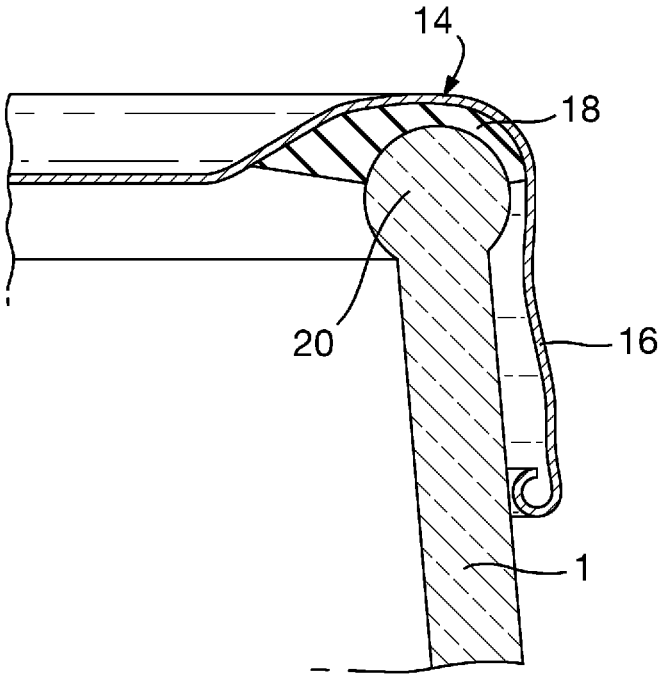
FIG. 14 is a view similar to FIG. 13 taken at the point B of FIG. 12.

A variant of the second embodiment is shown in FIGS. 12 to 14. In this embodiment, the container body is in the form of a glass tumbler having an annular bead 20 around its upper end. One or more venting features 10 are formed in the radial outer face of the bead. The recess in this variant has a depth of about 0.4 mm.

The closure may be formed with a plurality of lobes at the bottom of the skirt. These lobes form clips which provide a loose snap-over fit with the bead of the body to assist in re-fitting the closure after opening. They do not, however, play any part in making a seal between the closure and the container body and must be pushed upwardly past the bead after the seal has been broken.

Figure 1:
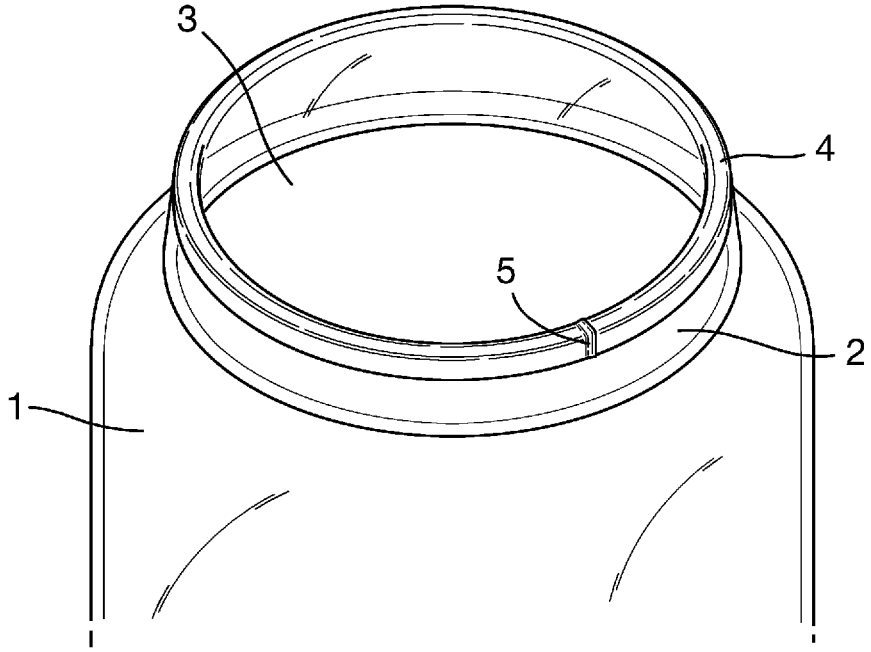
FIG. 1 is an isometric view of the top portion of a first container body.
Figure 2:
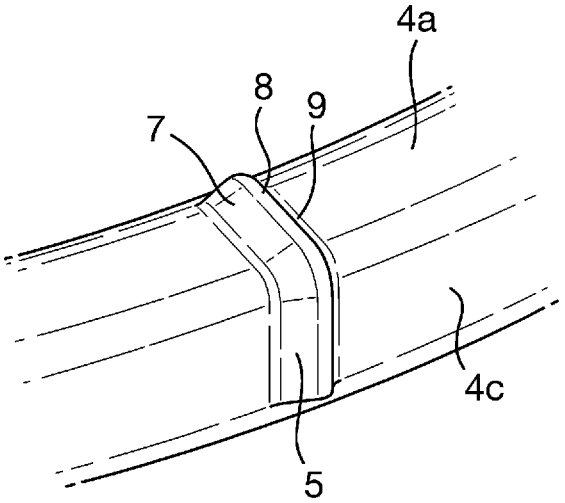
FIG. 2 is an enlarged view of part of the neck of the body.
Figure 3:
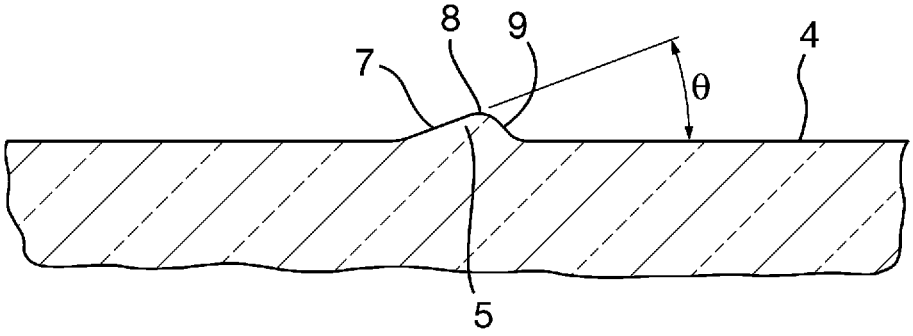
FIG. 3 is a partial section showing the profile of a protrusion formed on the annular sealing surface of the body.
Figure 4:
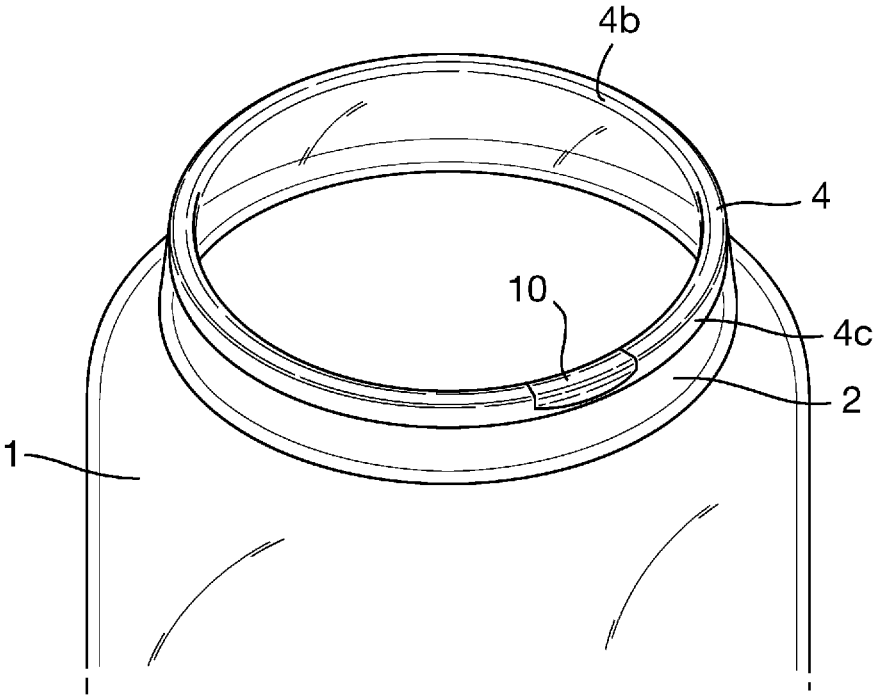
FIG. 4 is a isometric view of the top portion of a second container body.
Figure 5:
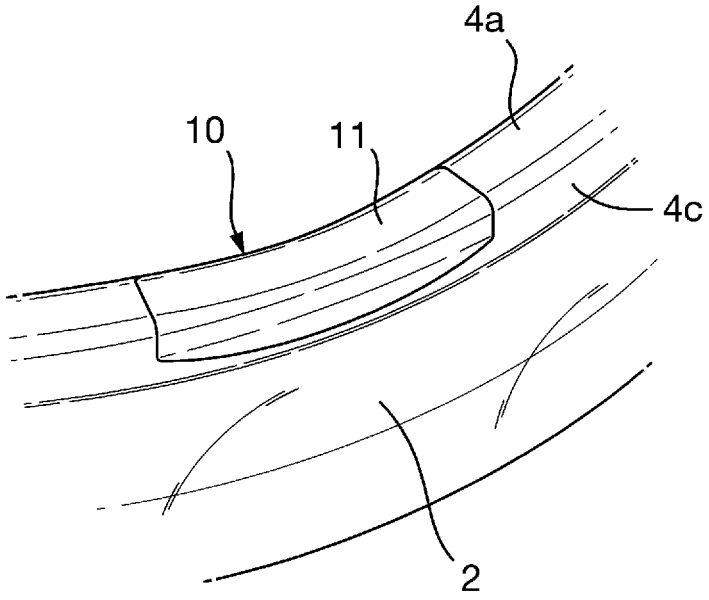
FIG. 5 is an enlarged view of part of the neck of the second body.
Figure 6:
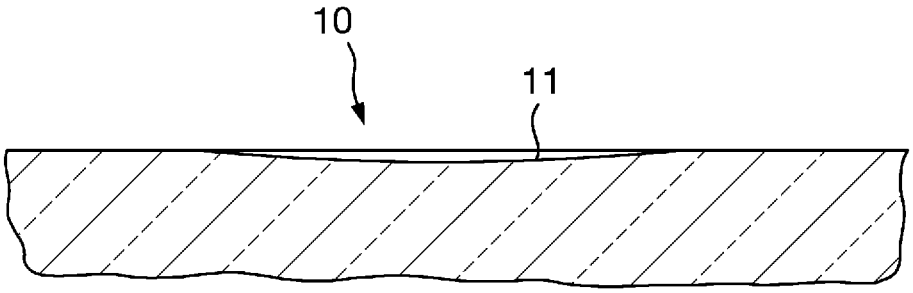
FIG. 6 is a partial section showing the profile of a recess formed on the annular sealing surface of the second body.
Figure 7:
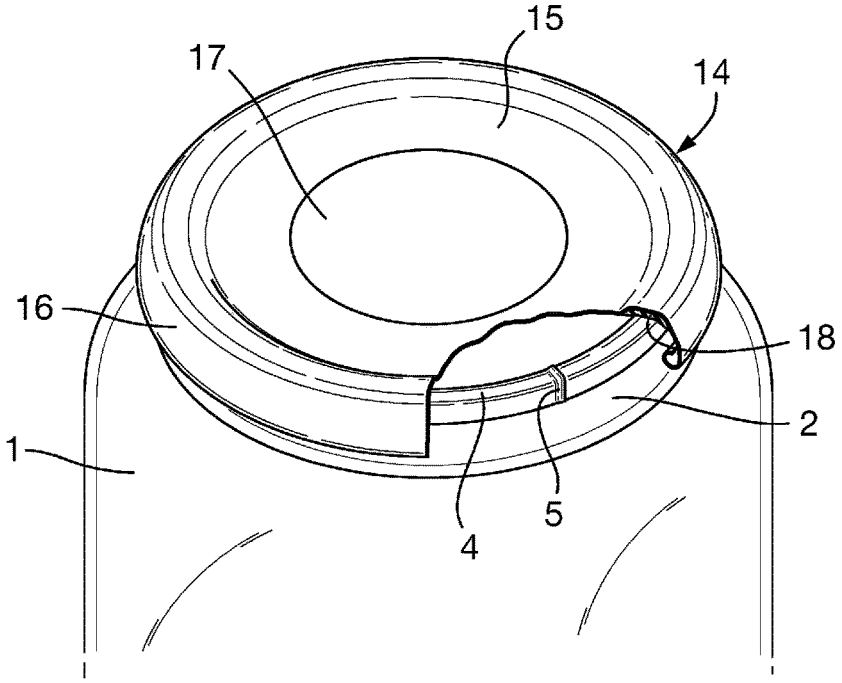
FIG. 7 is an isometric view, partially cut away, of the top portion of the first container body provided with a closure.
Figure 8:
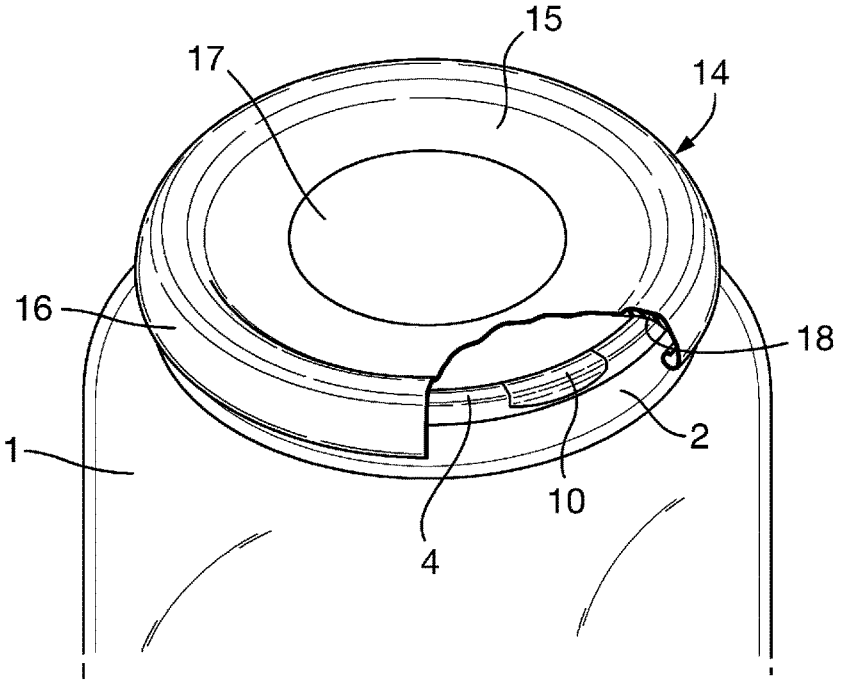
FIG. 8 is an isometric view, partially cut away, of the top portion of the second container body provided with a closure.

Releasable closures 14 (of type known as vacuum closures) for the first and second containers are shown in FIGS. 7 and 8 and comprise an end wall 15 and a depending skirt 16. The end wall has a central pop-up panel known as a "vacuum button" 17 which is normally held in a concave shape by the partial vacuum in the closed container. The button pops-up to a convex shape to give a warning that the vacuum has been vented and thus the seal has been broken. An annular layer 18 of sealing compound is formed on the inside of the closure end wall adjacent the skirt 16. This layer of compound seals against the annular sealing surface 4 of the container neck over an annular sealing interface in the closed position of the closure 14 on the body 1. The sealing compound is PVC plastisol and is applied to the closure through a nozzle and allowed to settle under gravity to form a generally even annular layer. It is cured before the filling process but will be softened during the filling and capping process by the steam in the head space above the food product so that it can flow around or into the venting feature 5, 10 and set around the annular sealing surface 4.

Other flowed materials are available to avoid the use of PVC, and compound gaskets may also be made from injection moulded or compression moulded thermoplastics or thermoplastic elastomers. In some cases a separate disc or ring of elastomeric material is inserted into the closure to form the compound gasket.

During capping the compound is typically heated and applied with an axial load so that it deforms to the jar profile to create a gas tight seal. The jar may then be processed by pasteurisation or sterilisation to provided extended shelf life of the product. During capping, processing or subsequent storage and distribution the compound typically takes a permanent set so that the profile when opened is different to the original uncapped profile.

To aid opening the compound often includes a lubricant material to reduce the coefficient of friction between the glass gar and compound.

Figure 10:
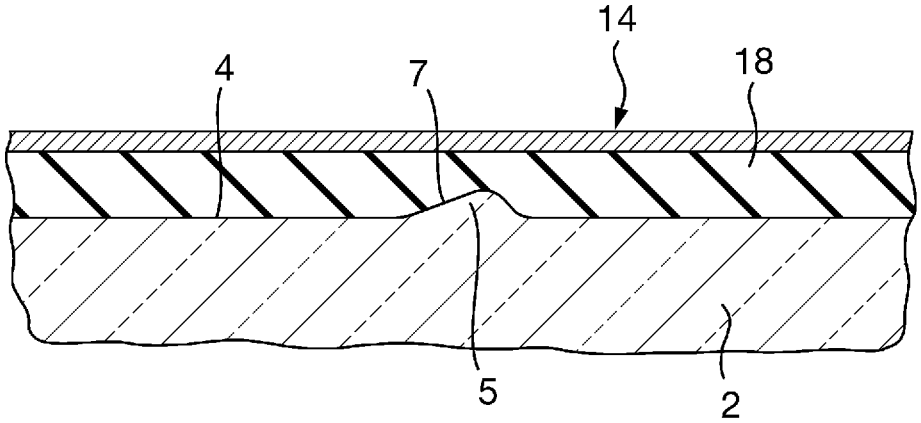
FIG. 10 is a circumferential sectional view through part of the first container and closure in the closed portion.
Figure 11:
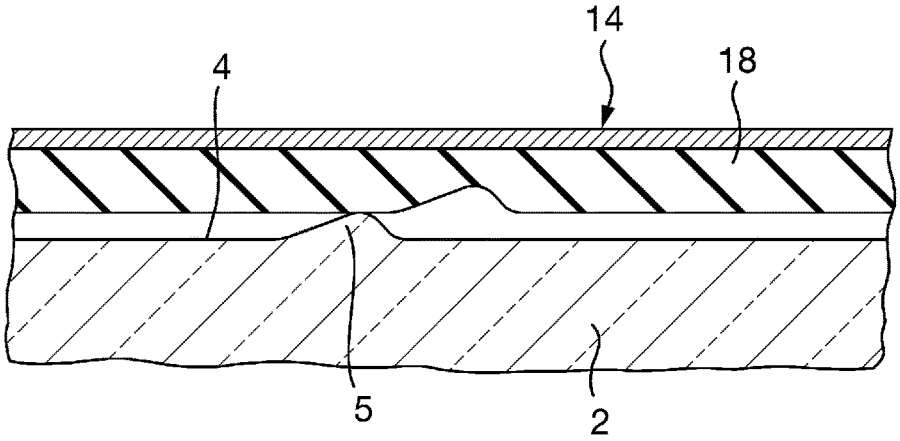
FIG. 11 is a circumferential sectional view through part of the first container and closure after relative rotation.

An enlarged sectional view through part of the first container and closure in the closed position is shown in FIG. 10. As can be seen, the venting feature 5 extends upwardly across the annular sealing interface and partially into the layer 18 of sealing compound. During capping of the filled container, the sealing compound deforms so that its thickness between the closure end wall 15 and the upper edge of the container reduces. Typically, this reduction is from about 1 mm to about 0.5 mm. The height of the venting feature 5 is less than the thickness of the layer of sealing compound after fitting of the closure to the container body. When the closure 14 is rotated relative to the container body (it will be natural for the closure to be rotated anti-clockwise since consumers are accustomed to opening containers in this way) venting of the vacuum in the container takes place. Venting takes place because there is a path created between the compound and container. After venting and further rotation the closure moves away from the container as shown in FIG. 11.

Prior to capping, a food or beverage product is put into the container and steam is injected into the headspace above the product. The closure cap is then pressed downwardly onto the container body so that a seal is formed. The inserted steam rapidly condenses and this forms a partial vacuum in the headspace to hold the closure firmly on the container body.

Following capping, the filled container is then normally processed according to the required food preservation conditions, for example products high in sugar, acid or salt may just need to be hot filled or pasteurised at 85 to 100.degree. C. whereas meat based products which have no natural preservatives require a full sterilisation process at 121 to 130.degree. C. to preserve the food product. Specific compound types have been developed to meet the differing processing conditions, for example a blown compound is typically used for pasteurised products as this has entrapped pockets of gas within the sealing layer which make the compound flexible in order to conform to the sealing surface at relatively low temperatures. For sterilised products less or no blowing agents may be used in order to form a stiffer sealing layer which is more resilient and suitable for higher temperature processing. The inventors have found that the stiffer non blown materials are particularly suitable for creating a venting feature. In this case the compound better retains the shape memory of the discontinuity after processing and forms a stable vent path when the cap is first rotated.

Opening of the second container takes place in a similar manner. In this embodiment, the sealing compound extends downwardly across the annular sealing interface and fills the venting feature 10. The depth of the recess must be less than the difference in the depth of the layer of sealing compound before and after fitting of the closure. This ensures that the recess is completely filled with sealing compound.

When the closure is rotated, a path is created between the sealing compound and the container since the two surfaces no longer conform to each other.

The container bodies 1 of the first and second containers are made of glass and the closures are made of metal, preferably steel.

It is preferred that only a single venting feature is provided for two reasons; firstly, there is a load induced by each feature so having just one reduces the overall load. Secondly, the axial load required for lifting the panel against the vacuum is lower if it is only on one side. Two or more may be provided but it is believed that the best solution is to have only one since this reduces the torque required to open the container.

It will be understood that the closure cannot be properly resealed to the container body after opening and release of the vacuum. This arrangement is appropriate for food products which should be consumed immediately once the container has been opened although the closure may be replaced on the container and used as a cover, for example where food is stored in the fridge.

The body 1 and closure 14 are formed with no mechanical engagement means for coupling them together to form or maintain a seal therebetween and the seal is provided by a partial vacuum formed in the container during processing. In particular, the closure is not threaded or crimped onto the container body.

What is claimed:

1. A container comprising:

a releasable metal closure including an end wall and a depending skirt, the closure having an annular layer of sealing compound on an inside surface of the end wall adjacent the skirt; and a glass container body comprising a neck with an annular sealing surface, the neck defining a circular opening of the body, the sealing surface defining a localized protrusion or recess, the sealing surface being adapted to form a sealing interface with the annular layer of sealing compound such that when the closure is in a closed position on the container body, the localized protrusion or recess provides a discontinuity in the annular sealing interface;

wherein a seal is made by a partial vacuum formed in an interior of the container during processing without mechanical engagement between the closure and the container body; and whereby the container is configured such that relative rotation of the closure and the container body from the closed position creates a venting path proximate the discontinuity from the interior of the container body to an exterior of the container so that the seal is broken.

2. A container as claimed in claim 1, wherein the discontinuity in the annular sealing surface extends continuously about the container body neck from the interior of the container body to the exterior of the container body.

3. A container as claimed in claim 1, wherein the localized protrusion or recess is a protrusion on the annular sealing surface which extends into the layer of sealing compound in the closed position of the closure on the container body.

4. A container as claimed in claim 3, wherein the protrusion extends generally radially across the annular sealing surface.

5. A container as claimed in claim 4, wherein the protrusion has a curved profile generally comprising an upslope, a curved top and a downslope, wherein the upslope is inclined to the annular sealing surface at an angle $\theta$ of less than 30°.

6. A container as claimed in claim 1, wherein the localized protrusion or recess is a recess in the annular sealing surface and the sealing compound of the closure extends into and at least partially fills the recess to form the discontinuity in the annular sealing interface.

7. A container as claimed in claim 1, wherein the protrusion or recess is generally smooth such that radii defined by the protrusion or recess are at least as large as the depth or height of the protrusion or recess.

8. The container as claimed in claim 1, wherein the sealing compound is a non-blown material which permanently sets during processing such that, after the sealing compound cools after processing and the container is opened, a physical vent path is retained in the sealing material.

9. The container as claimed in claim 1, wherein a height of the protrusion or a depth of the recess is less than the thickness of the layer of sealing compound adjacent the protrusion or recess after the closure has been fitted to the container.

10. The container as claimed in claim 1, wherein the localized protrusion or recess is a recess and a depth of the recess is less than difference in thickness of the sealing compound adjacent the recess before and after the closure is in the closed position.

11. The container as claimed in claim 1, wherein the annular sealing interface consists essentially of only one discontinuity such that the relative rotation of the closure and the container body creates an eccentric force which breaks the seal.

12. The container as claimed in claim 1, wherein the annular sealing interface comprises multiple discontinuities such that the relative rotation of the closure and the container body forms several vent features.

13. The container as claimed in claim 1, whereby the container is configured such that the relative rotation that creates the venting path includes twisting the closure relative to the container body.

14. The container as claimed in claim 13, whereby the container is configured such that the relative rotation that creates the venting path includes twisting the closure relative to the container body about an axis along which the container body is elongate.

* * * * *